US005379570A

United States Patent [19]

Terjung et al.

[11] Patent Number: 5,379,570

[45] Date of Patent: Jan. 10, 1995

[54] SLEEVING MACHINE

[76] Inventors: Herman F. Terjung, 412 N. Exeter St., Baltimore, Md. 21202; David P. Crum, 4207 Kolb Ave., Baltimore, Md. 21206

[21] Appl. No.: 25,843

[22] Filed: Mar. 3, 1993

[51] Int. Cl.[6] ..... B65B 13/02; B65B 19/18; B65B 57/06; B65B 57/18

[52] U.S. Cl. ..... 53/399; 53/458; 53/169; 53/566; 53/585; 53/259; 53/505; 53/508

[58] Field of Search ..... 53/399, 458, 459, 169, 53/176, 566, 585, 255, 258, 259, 508, 505, 64, 77

[56] References Cited

U.S. PATENT DOCUMENTS 1,407,581 2/1922 Rose .
1,473,496 11/1923 Molins .
3,293,825 12/1966 Schmermund .
3,299,610 1/1967 Webster .
3,455,086 7/1969 Bescript et al. .
3,728,945 4/1973 Vuilleumier ..... 53/566 X
4,012,887 3/1977 Calvert et al. .
4,693,055 9/1987 Olsen, Jr. et al. .
4,730,437 3/1988 Benno ..... 53/585 X
4,835,944 6/1989 Herrin ..... 53/169 X
4,869,052 9/1989 Calvert .
4,926,616 5/1990 Zielke et al. ..... 53/566 X

*Primary Examiner*—Linda B. Johnson
*Attorney, Agent, or Firm*—Leonard Bloom

[57] ABSTRACT

A sleeving machine and a method for automatically inserting a tray of postal mail into a sleeve. The tray is disposed on a transport station and advanced by a first belt. A second belt having a pusher thereon engages the tray for advancement through the machine. Collapsed sleeves are dispensed as required from a hopper into a sleeving station. Arcuate guides in the sleeving station open the sleeves to receive the tray. The second belt with the pusher advances the tray into the open sleeve and then advances the sleeve, with the tray therein, out of the sleeving station. Sensors are provided to control and coordinate movement of the second belt and dispensing of the sleeves from the hopper into the sleeving station. Safety features are provided.

18 Claims, 8 Drawing Sheets

SLEEVING MACHINE

The present invention relates to a sleeving machine and a method for automatically inserting a tray of postal mail with a sleeve and, more particularly, to the machine and method which automatically dispenses and opens collapsed sleeves, advances and inserts therein the tray and advances the sleeve containing the tray from the machine.

BACKGROUND OF THE INVENTION

The postal service has directed considerable resources to improving the sorting and delivery of letters and related postal matters. Automated scanners sort mail by zip code and automatic equipment is available for transporting the mail within the separate postal stations. As part of this concept the postal service employs a system in which mail, such as letters addressed to a single destination (e.g., one zip code), is placed in a marked tray. In order to prevent loss of the individual letters, or the introduction of letters for an alternate destination, the tray is inserted into an open-ended sleeve. Thus, the tray in the sleeve is easily transported. The insertion of the tray into the sleeve is presently being performed manually which is inefficient, slow and labor intensive and is a portion of the overall mail handling approach which is urgently in need of improvement.

An apparatus for inserting articles into open-ended receptacles is disclosed in U.S. Pat. No. 1,407,581 issued to Rose Feb. 21, 1922. Outer members are fed into the apparatus in a collapsed condition by a pair of arm-like pushers and opened by a wedge-shaped member. A reciprocatable slider thrusts the inner member into the outer member. U.S. Pat. No. 3,299,610 issued to Webster Jan. 24, 1967 discloses an apparatus for filling sleeve packages wherein a carton or sleeve is erected at the sleeving station with an open end thereof directed along the path of a package which is moving along a predetermined path toward the sleeving station. The carton or sleeve is held stationary while the package is pushed into the open end of the carton or sleeve. U.S. Pat. No. 4,012,887 issued to Calvert Mar. 22, 1977 discloses a packaging machine which withdraws collapsed sleeve-type containers from a hopper by suction means and sets up the sleeve to receive bottles through the open end. End flaps are closed on the sleeve. U.S. Pat. No. 4,693,055 issued to Olsen, Jr. et at Sep. 15, 1987 disclose a machine for feeding beverage cans to open-ended carrier sleeves. U.S. Pat. No. 4,869,052 issued to Calvert Sep. 26, 1989 discloses a packaging machine. Collapsed sleeve-type articles are withdrawn in sequence from a hopper by suction cup means which then holds each carton at a loading station while a plurality of articles are inserted through an open end of each container. Flaps for the open ends of the container are then closed.

Although the packaging machines are useful for the purposes for which they were designed, a simpler, more efficient sleeving machine is needed for the postal service requirements.

SUMMARY OF THE INVENTION

Accordingly, it is a primary object of the present invention to provide a sleeving machine which efficiently and automatically inserts a tray into an opened sleeve.

It is a further object of the present invention to coordinate insertion of trays into sleeves in a continuous and uninterrupted manner.

In accordance with the teachings of the present invention, there is disclosed a sleeving machine for automatically inserting a tray of postal mail into a sleeve. The sleeve has a top, a bottom, two sides and two open ends. The machine includes a transport station having a first side, a second side, a first end and a second end. The sides are substantially perpendicular to the ends. A first continuous belt means is disposed between the sides of the transport station such that when the tray is disposed on the first belt means, the tray may be moved from the first end to the second end of the transport station. A second continuous belt means is disposed adjacent to and parallel to the first belt means between the sides of the transport station. At least one pusher means is attached to the second belt means such that the at least one pusher means may engage the tray. A sleeving station is adjacent to the second end of the transport station. The second belt means extends through the sleeving station wherein the at least one pusher means advances the tray in a direction from the transport station to the sleeving station. A hopper adjoins the sleeving station, the hopper containing therein a plurality of collapsed sleeves. Means are provided for dispensing the collapsed sleeves one at a time as desired, into the sleeving station. Means are provided for opening the collapsed sleeve wherein the open ends of the sleeve are oriented in the direction of movement of the tray such that the tray may be advanced by the at least one pusher means and be disposed inside the opened sleeve. Power means are provided to drive the first belt means, the second belt means and the means for dispensing the folded sleeve from the hopper. Sensing means are provided to coordinate the movement of the second belt means with the means for dispensing the folded sleeve to assure continuous, uninterrupted advancement of the tray and insertion of the tray into the opened sleeve, to permit the at least one pusher means to advance the sleeve containing the tray out of the sleeving station and to further permit sequential repetition by the machine.

In further accordance with the teachings of the present invention, a method is disclosed for automatically inserting a tray of postal mail into a sleeve.

These and other objects of the present invention will become apparent from a reading of the following specification, taken in conjunction with the enclosed drawings.

DESCRIPTION OF THE PREFERRED EMBODIMENT

Figure 1:
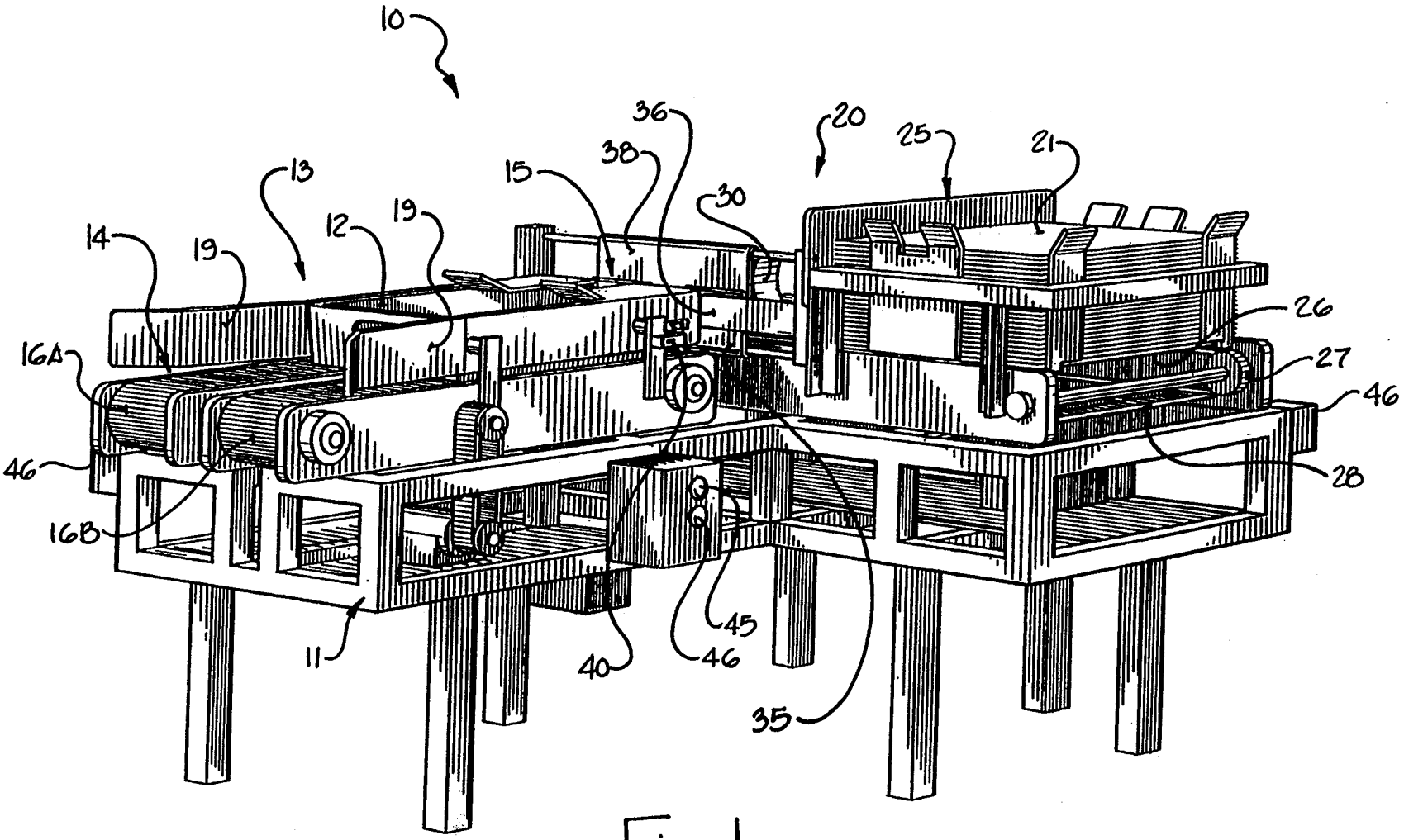
FIG. 1 is a perspective view of the sleeving machine of the present invention.
Figure 2:
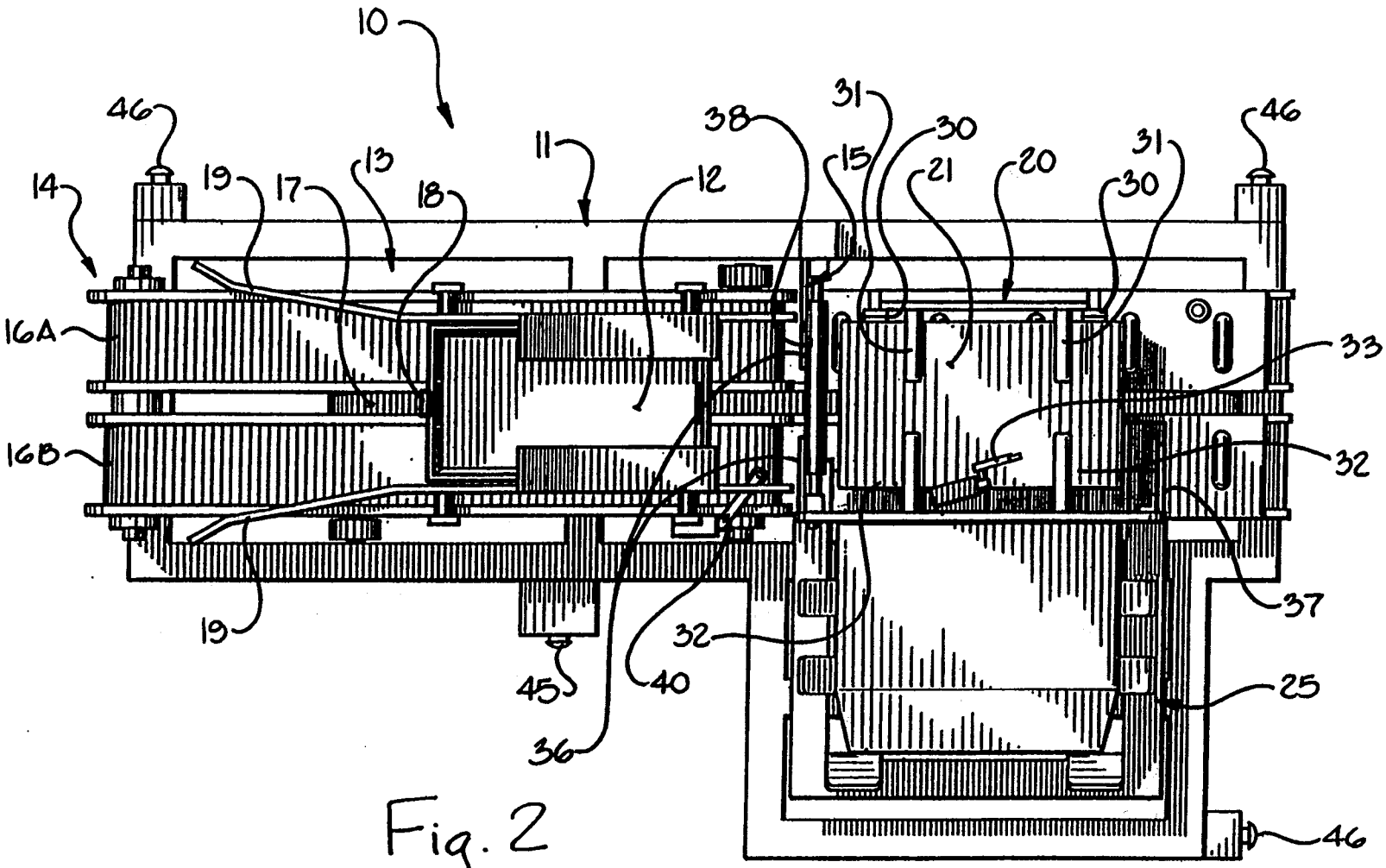
FIG. 2 is a top plan view of the sleeving machine of FIG. 1.
Figure 3:
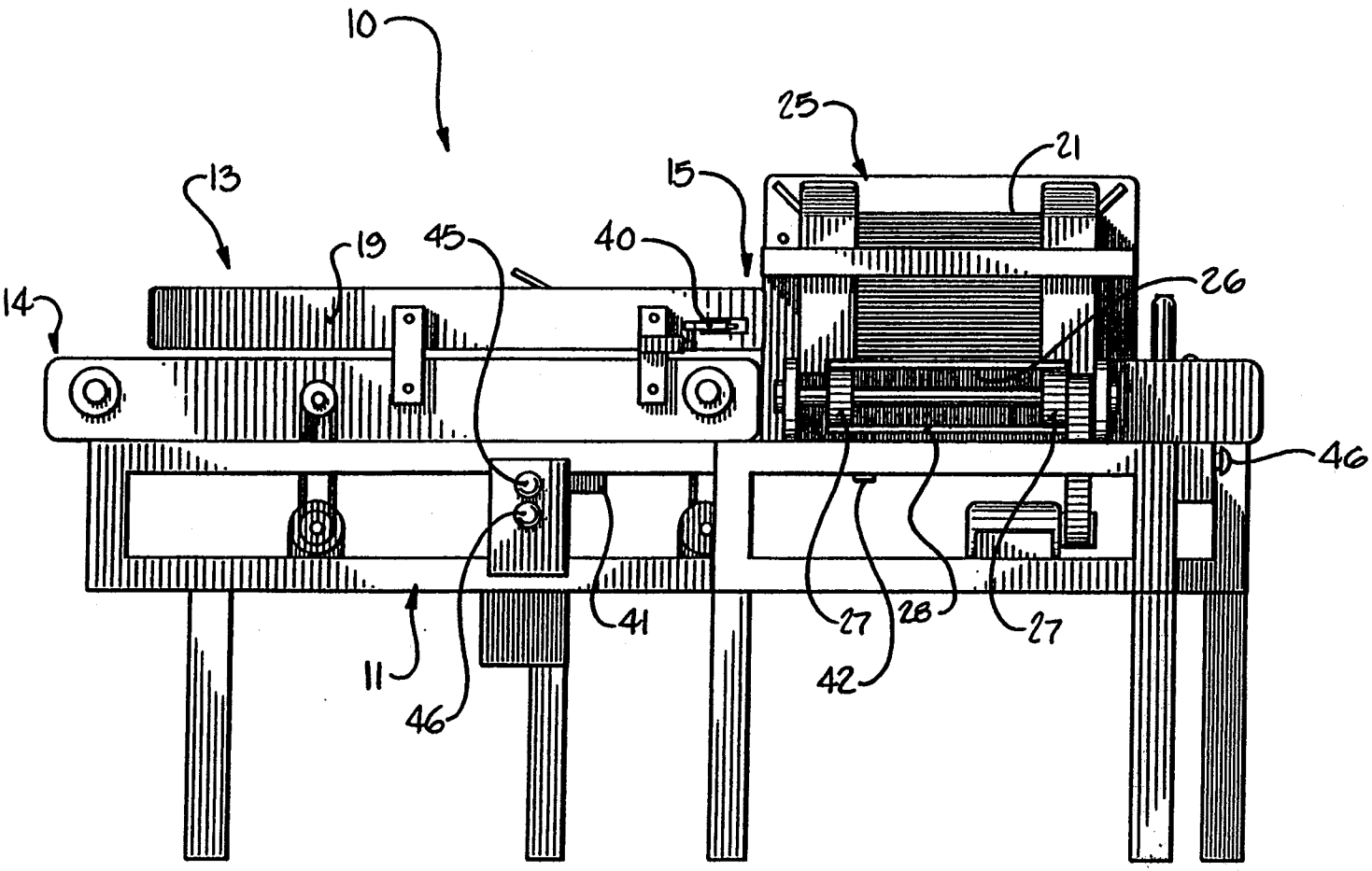
FIG. 3 is a side elevation view of the sleeving machine of FIG. 1.
Figure 4:
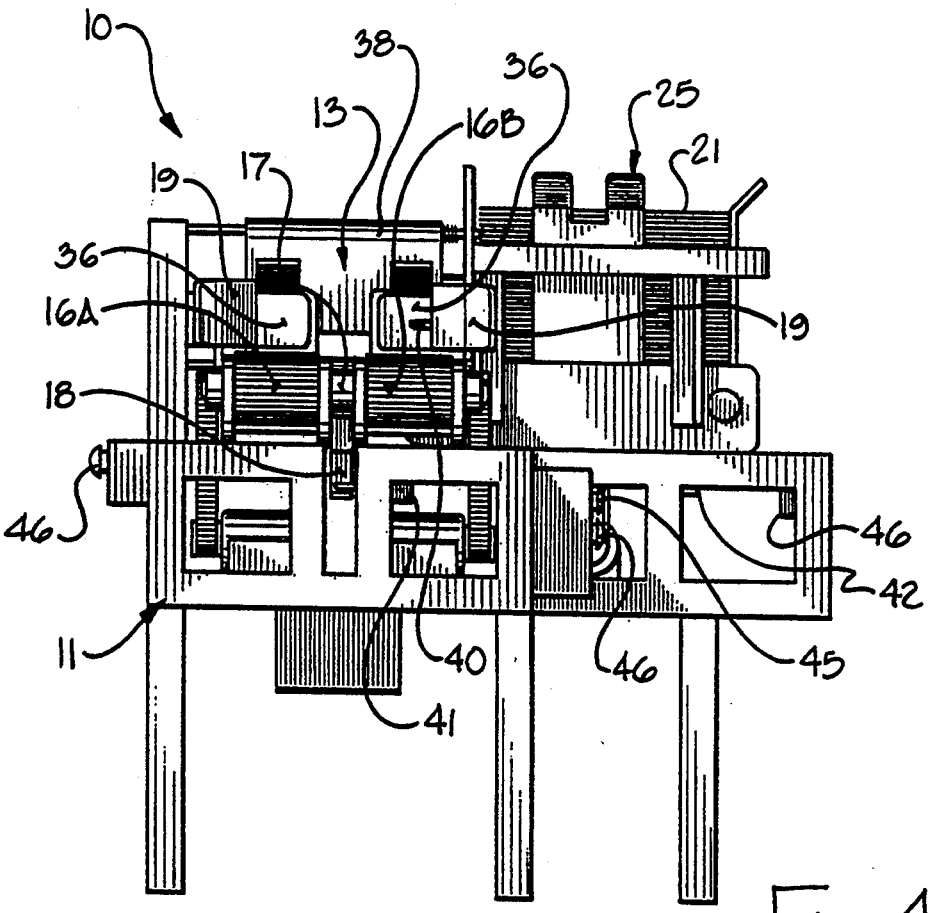
FIG. 4 is a front elevation view of the sleeving machine of FIG. 1.
Figure 5:
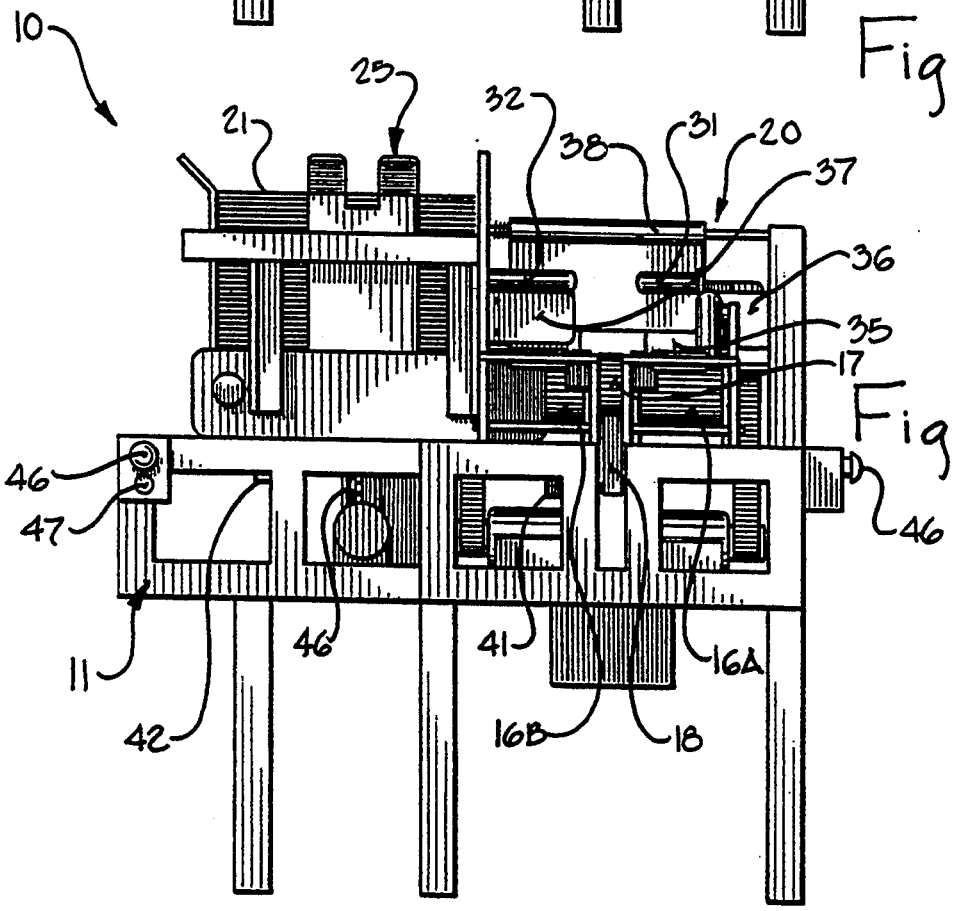
FIG. 5 is a back elevation view of the sleeving machine of FIG. 1.

Referring now to FIGS. 1–6 the sleeving machine 10 includes a frame 11 having legs which can be adjusted to provide an overall height of the machine ranging from 32 inches to 42 inches. If desired the frame may be mounted on industrial grade casters to permit moving the sleeving machine 10 by just one person.

The tray 12 used with the sleeving machine 10 is formed of fiberboard or plastic and is commonly used by the postal service. The tray 12 has a bottom approximately 22 inches long and 10¼ inches wide. The tray 12 is approximately 4¾ inches in height. The tray 12 has two sidewalls and two ends, the sidewalls and ends are slanted outwardly from the bottom so that the top of the tray 12, which is open, is approximately 25 inches long and 11½ inches wide. The letters or other postal mail is placed in the open top of the tray 12 and when so loaded, the tray 12 and mail have an average weight of 17.5 lbs.

The tray 12 with postal mail therein is placed on a transport station 13 of the sleeving machine 10 which is on the top of the frame 11. The transport station 13 has a first end 14 and a second end 15 with first and second sides substantially perpendicular to the ends 14, 15. A first belt means 16 is disposed between the sides of the transport station 13, the belt means preferably being a pair of spaced-apart belts 16A, 16B, each belt being a continuous belt or conveyor. The belt means 16 is power driven and is driven without interruption as long as power is provided to the sleeving machine 10. An on-off switch is provided as will be described. The belt means 16 extend between the first end 14 and the second end 15 of the transport station 13. The belt means 16 convey the tray 12 through the transport station 13. A second belt means 17 is disposed in the space between the pair of belts 16A, 16B of the first belt means 16 and extends beyond the transport station 13 as will be described. The second belt means 17 is a continuous belt and is power driven. The second belt means 17 is disposed on an approximate center line of the transport station 13.

Figure 7:
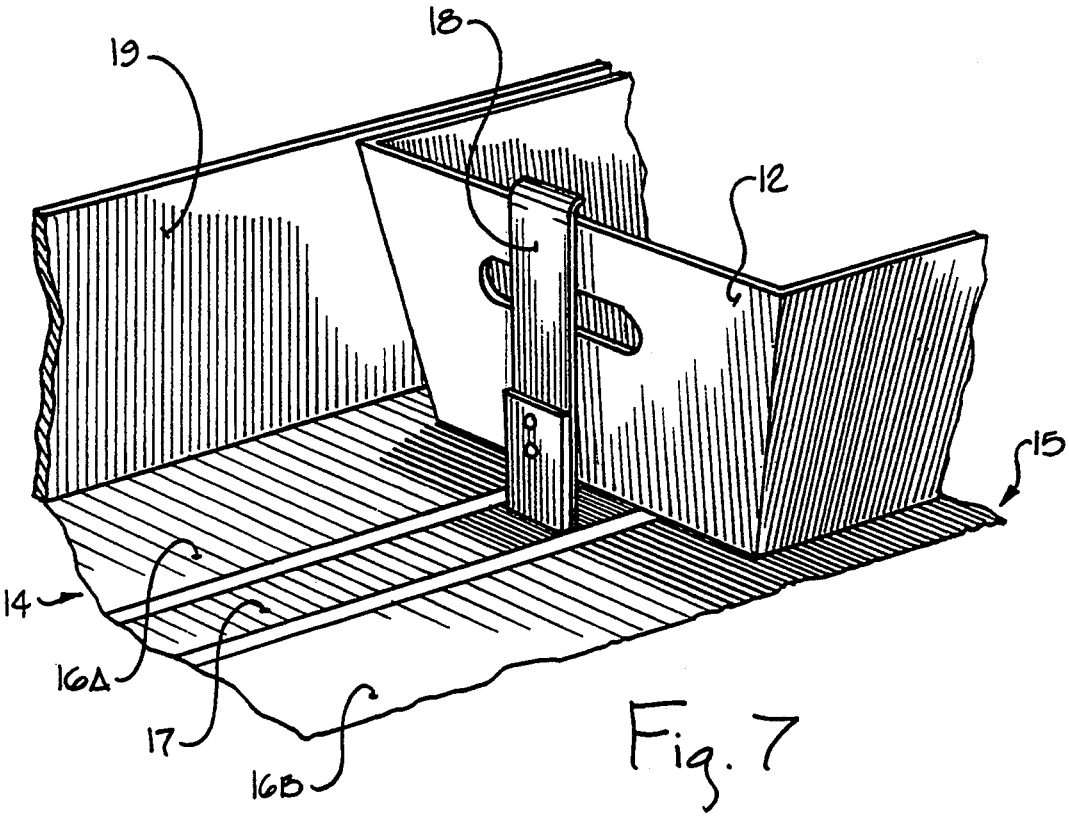
FIG. 7 is a perspective view showing the pusher means engaging the tray.
Figure 8:
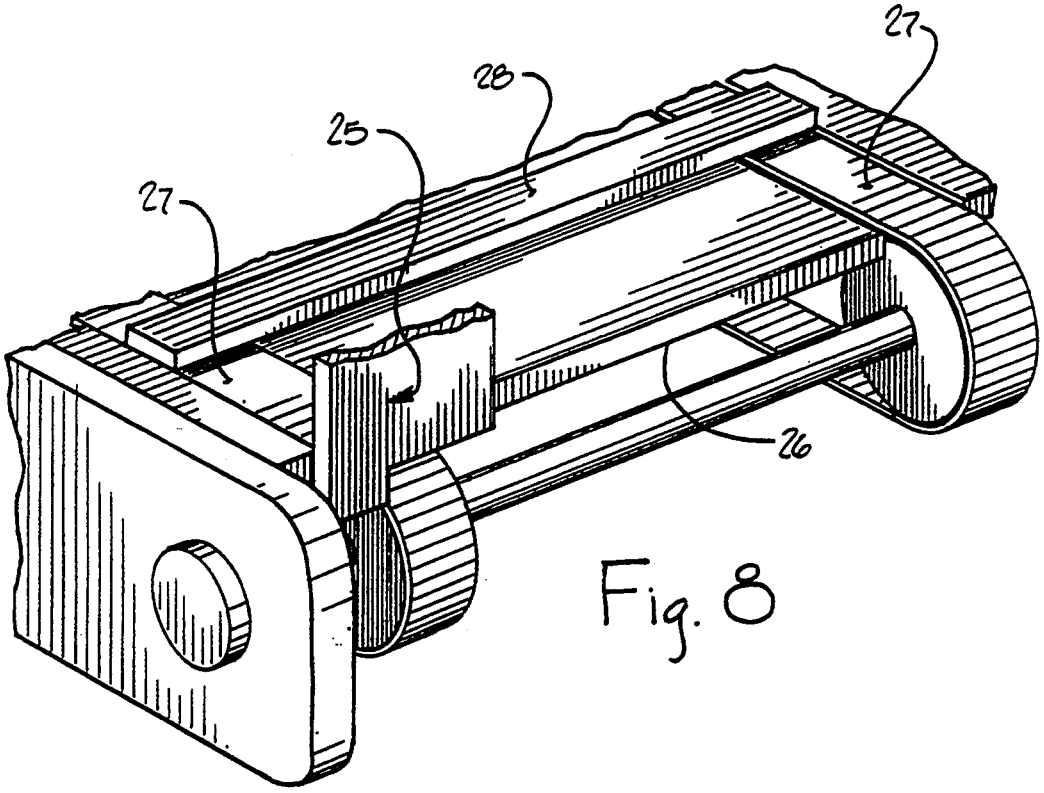
FIG. 8 is a perspective view showing means for dispensing the collapsed sleeve from the hopper.
Figure 9:
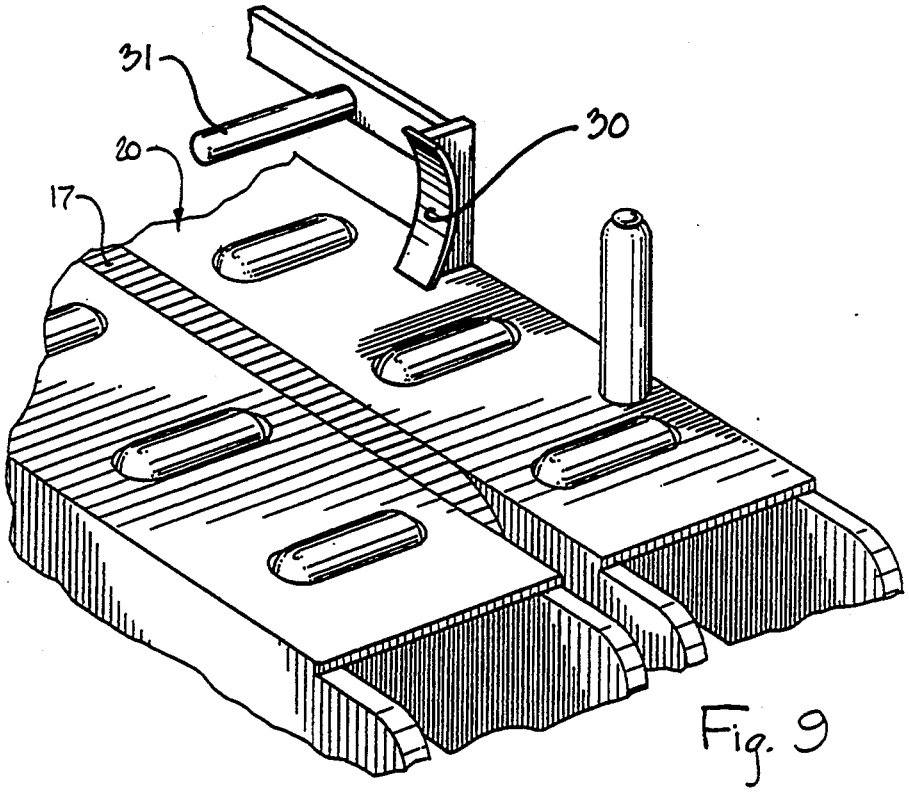
FIG. 9 is a perspective view showing the arcuate guide disposed in the sleeving station.

Attached to the second belt means 17 is at least one pusher means 18. Preferably, two spaced-apart pusher means 17 are attached but more than two pusher means 17 may be provided. The pusher means 18 has a tongue-like shape and is attached to the second belt means 17 so as to extend outwardly from the second belt means 17 so that, as the second belt means 17 is driven, the pusher means 18 protrudes above the surface of the transport station 13. The protruding pusher means 18 may thereby engage the approximate mid-point of the end of the tray 12 which is nearest to the first end 14 of transport station 13 and advance the tray 12 to the second end 15 of the transport station (FIG. 7). Preferably, the pusher means 18 extends at an angle from the second belt means 17 to cooperate with the angle on the end of the tray 12. The pusher means 18 assists in advancing the tray 12 in approximately a straight line through the transport station 13.

Each side of the transport station 13 has a guide 19 mounted thereon. The guides 19, preferably are mounted angularly from the first end 14 toward the second end 15 of the transport station 13 to direct and approximately center the tray 12 as the tray 12 is advanced through the transportation 13.

A sleeving station 20 is adjacent to the second end 15 of the transport station 13. The second belt means 17 extends through the sleeving station 20 and is disposed in the approximate center of the sleeving station 20. In this manner, the second belt means 17, with the pusher means 18 attached thereto, advances the tray 12 and the sleeve 21 commonly used by the postal service, as will be described.

A hopper 25 is disposed adjoining and substantially perpendicular to, the sleeving station 20. The hopper 25 contains a plurality of collapsed sleeves 21. Each sleeve 20 is fiberboard having a top (24½ inches long, 11½ inches wide), a bottom (22 inches long, 11½ inches wide) and two sides therebetween (each side being 5 inches in height). Each side is trapezoidal in shape, the ends being angled outwardly from the bottom toward the top. The collapsed sleeve 21 may be opened by applying pressure against the folded edges and, when opened, forms a box-like shape having two open ends. The opened sleeve 21 is dimensioned to receive therein, the tray 12 through the open end. The collapsed sleeves 21 are stacked and rest on the bottom 26 of the hopper 25. At least one and preferably two, hopper belts 27 are mounted in the bottom 26 of the hopper at an angle of approximately 90° with respect to the second belt means 17 which extends through the sleeving station 20 adjoining the hopper 25. The hopper belts 27 are continuous belts and are power driven, being activated as desired and as will be described. The use of two hopper belts 27 provide more control and increase the use life of the belt 27. When the hopper belts 27 are driven, the collapsed sleeve 21 on the bottom of the stack, which is directly adjacent to the bottom 26 of the hopper 25, is transported from the hopper 25 into the sleeving station 20. A sleeve pusher bar 28 is connected to the hopper belts 27 and engages the folded edge of the collapsed sleeve 21. As the hopper belts 27 move toward the sleeving station 20, the sleeve pusher bar 28 advances the bottom most sleeve 21 into the sleeving station 20. Preferably, two spaced-apart sleeve pusher bars 28 are connected to the hopper belts 27. If desired, the portion of the frame 11 which supports the hopper 25 may be separated from the portion of the frame 11 which supports the transport station 13 and the sleeving station 20. Wheel means may be connected to the bottom of the frame 11 supporting the hopper 25 to provide a rapid and easy replacement of an empty hopper 25 with a hopper 25 filled with collapsed sleeves 21.

Figure 6:
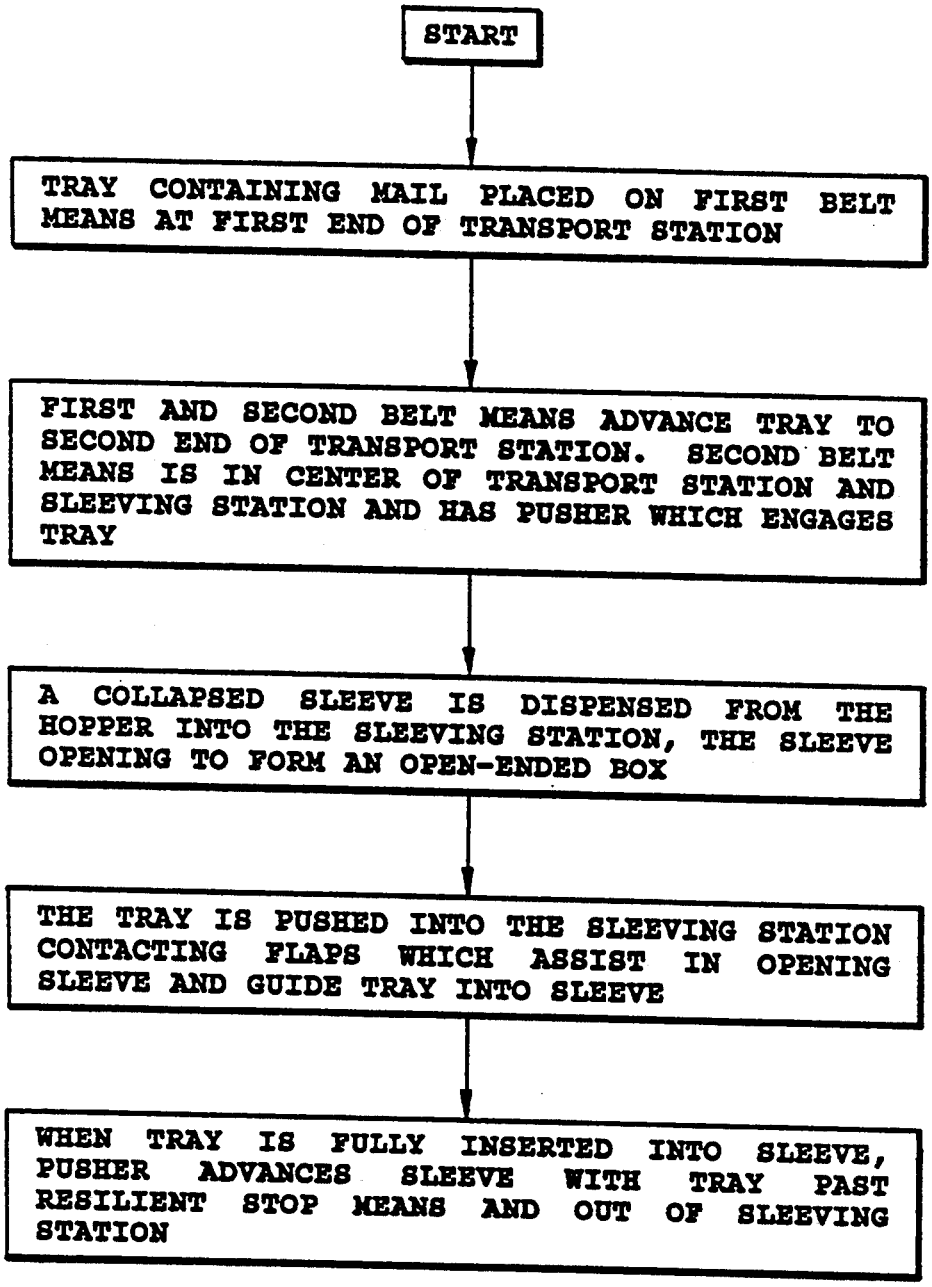
FIG. 6 is a flowchart showing the operation of the sleeving machine of the present invention.

When the collapsed sleeve 21 enters the sleeving station 20, the folded edge of the collapsed sleeve 21 distal from the sleeve pusher bar 28, and the hopper 25, contacts at least one, and preferably two, concave arcuate guides 30 (FIG. 6). The arcuate guides 30 are mounted on the base of the sleeving station 20 distal from the hopper 25, the lower edge of the arcuate guide 30 being at a distance from the hopper 25 slightly greater than the width of the bottom of the sleeve 21. The collapsed sleeve 21 has a width greater than the width of the bottom of the sleeve 21 and the folded edge distal from the hopper 25 is pushed onto the concave portion of the arcuate guide 30. As the distal folded edge of the sleeve 21 advances upwardly on the arcuate guide 30, the collapsed sleeve 21 is thereby caused to open. The collapsed sleeve 21 is completely opened by contact of the top of the sleeve with a member 31 connected to the side of the sleeving station 20, distal from the hopper 25 and adjacent to the top edge of the arcuate guide. The member 31 extends toward the hopper 25 and is substantially perpendicular to the hopper 25 and parallel to the surface of the sleeving station 20. The member 31 is in contact with the top of the sleeve 21 and assists in retaining the sleeve 21 in the sleeving station 20. Preferably a pair of hold down guide arms 32 are mounted perpendicularly on the hopper 25, each arm 32 extending outwardly over the sleeving station 20 on a horizontal plane approximately the same as the plane of the member 31. The arms 32 further provide guidance for the unfolding of the sleeve 21. A sensing means 33 is mounted on the hopper 25 extending over the sleeving station 20 in a manner similar to the arms 32 and in approximately the same horizontal plane as the arms 32. The sensing means 33 provides information that an unfolded sleeve 21 is disposed in the sleeving station 20 and this information is used in the control of the sleeving machine 10 as will be described.

Figure 10A:
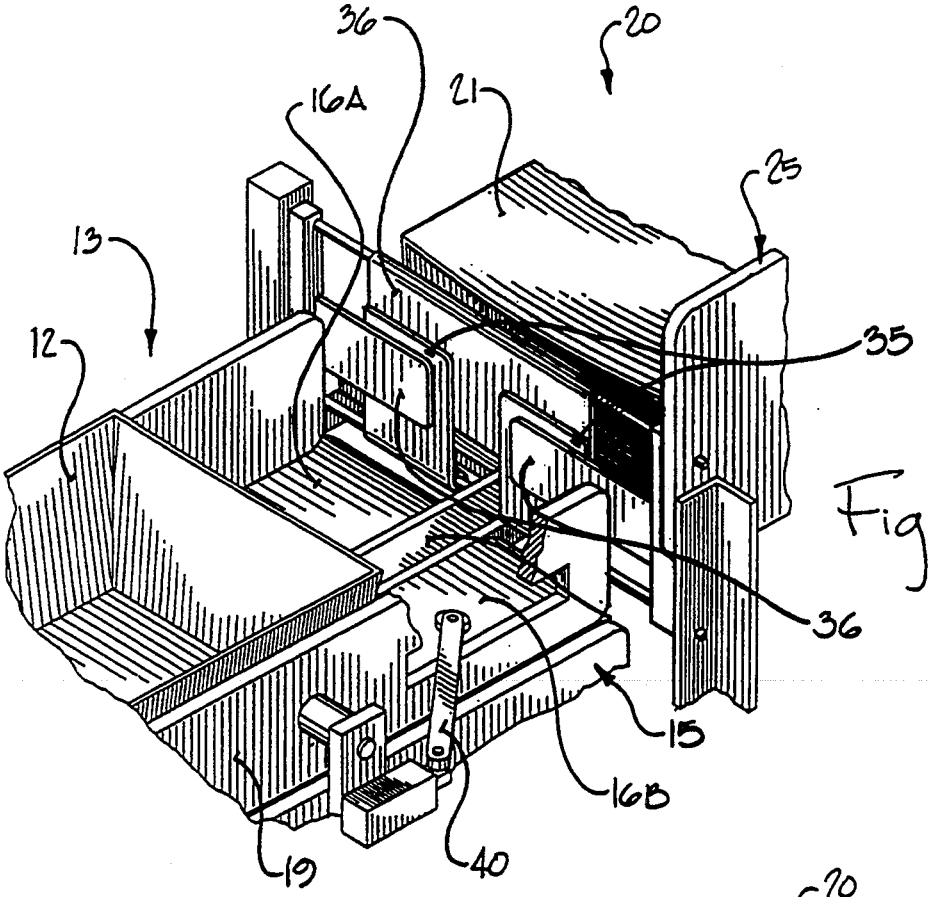
FIG. 10A—10B are perspective views showing the opening and closing of the flaps which hold the sleeve in an open position.
Figure 10B:
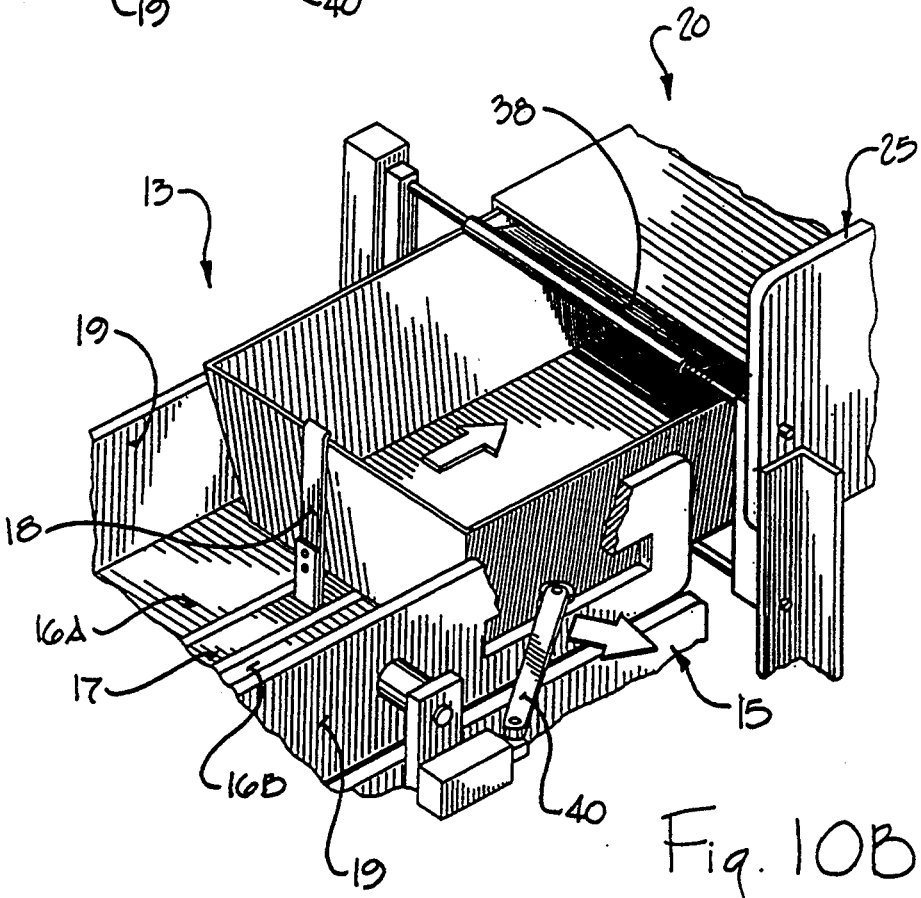

Disposed between the second end 15 of the transport station 13 and the sleeving station 20 are flaps, a first pair of flaps 35, a second pair of flaps 36 and a third flap 38. Preferably the first pair of flaps 35, and the flap 38 are mounted on respective rods extending across the sleeving machine 10 such that the flaps 35, 38 are substantially perpendicular to the second belt means 17. The first pair of flaps 35 is mounted side-by-side straddling the second belt means 17 and extending upwardly above the plane of the surface of the sleeving station 20. The second pair of flaps 36 are mounted on the opposite sides of the belts 16A, 16B and extend inwardly toward the second belt means 17. The third flap 38 is mounted above the first pair of flaps 35 and extends downwardly so that the first pair of flaps 35 is immediately adjacent to the third flap 38. If desired, the third flap 38 may be a pair of spaced-apart flaps. The third flap 38 is mounted above the surface of the sleeving station 20 at a height greater than the height of the tray 12 so that the tray 12 may pass under the mount. All of the flaps 35, 36, 38 are mounted in a hinged manner wherein the flaps may hingedly move so that the unmounted ends of the flaps are deflected in a direction toward the sleeving station 20. Preferably, the hinges are spring actuated so that the flaps 35, 36, 38 may return to the respective initial positions after being moved. However, gears or other means of permitting return of the respective flaps may be used. When the tray 12 is advanced from the transport station 13 into the sleeving station 20 due to the pusher means 18, the tray 12 initially contacts the flaps 35, 36, 38. The flaps 35, 36, 38 are urged into the open sleeve 21 disposed in sleeving station 20. The first pair of flaps 35 contact the bottom of the opened sleeve 21 and hold the sleeve 21 against the surface of the sleeving station 20. The second pair of flaps 36 are urged into the open sleeve 21 disposed in the sleeving station 20 and contact the sides of the opened sleeve 21. The third flap 38 is urged into the open sleeve 21 and contacts the top of the sleeve 21. The flaps 35, 36, 38 in this manner, fully open the sleeve 21 to facilitate entry of the tray 12 into the opened sleeve 21. As the tray 12 is received in the sleeve 21, the pusher means 18 on the second belt means 17 pushes the sleeve 21 containing the tray 12 out of the sleeving station 20 and the flaps 35, 36, 38 are urged to return to the initial respective positions which are substantially perpendicular to the surface of the sleeving station 20 (FIG. 10A–10B).

Figure 11:
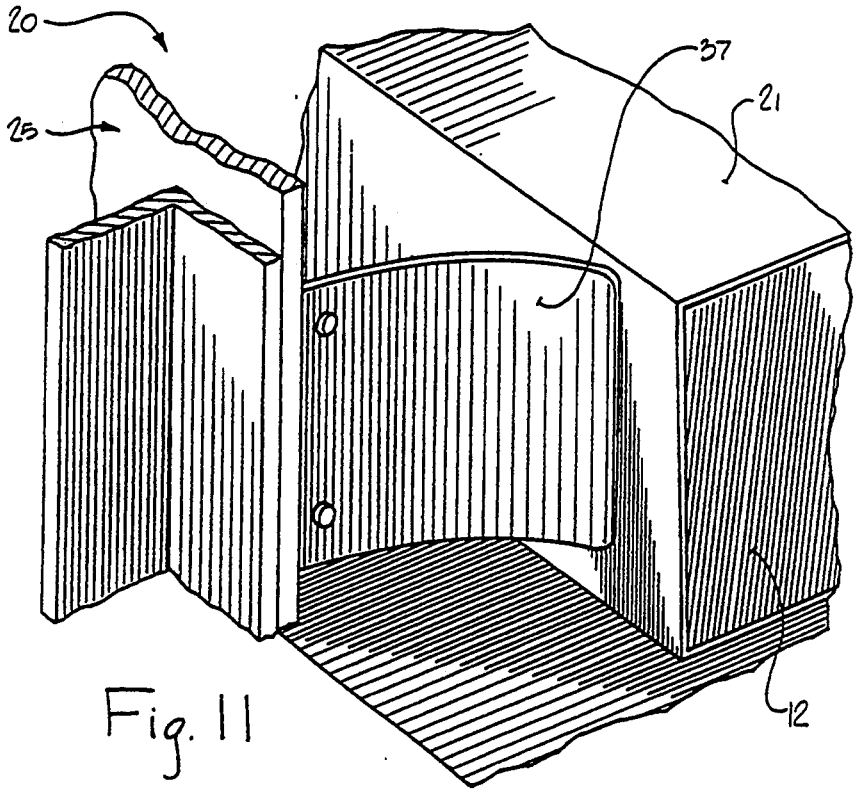
FIG. 11 is a perspective view showing the resilient stop means.

At the exit of the sleeving station 20 there is mounted at least one resilient stop means 37 (FIG. 11). Preferably the resilient stop means 37 is a pair of upright paddles 37, one paddle disposed on either side of the exit of the sleeving station 21 such that the sides of the sleeve 21 and tray 12 contact the respective paddles 37. In a preferred embodiment, each paddle 37 is mounted using a resilient material, such as a plastic interface, so that the resiliency may be overcome and the paddle 37 may be pushed outwardly from the sleeving station 20 when the sleeve 21 containing the tray 12 exits from the sleeving machine 10. Other mounting means such as spring loaded hinges may be used. The resilient stop means 37 also serve to retain the opened sleeve 21 in the sleeving station 20 and further provide support for the opened sleeve 21 as the tray 12 is introduced into the opened sleeve 21 by restraining any longitudinal movement of the sleeve 21.

A control network is provided to obtain the required sequence of operations. When power is initially supplied to the sleeving machine 10, a sleeve 21 is dispensed from the hopper 25 and is opened in the sleeving station 20 as will be described. When the tray 12 is disposed in the transport station 13 on the first belt means 16, the tray 12 advances into the guides 19. A first sensor 40, mounted in the guide 19 near the second end 15 of the transport station 13, activates the second belt means 17 and pusher 18 to push the tray 12 past the flaps 35, 36, 38 into the sleeve 21 and through the sleeving station 20 past the resilient stop means 37. When the opened sleeve 21, with the tray 12 therein, is removed from the sleeving station 20, the sensing means 33, previously described, overrides third sensor 42, mounted under the hopper 25, activates the hopper belts 27 and the sleeve pusher bar attached thereto, so that a sleeve 21 is dispensed from the hopper 25 into the sleeving station 20. When the dispensed sleeve 21 opens in the sleeving station 20, the third sensing means 42 deactivates the hopper belts 27. Concurrently, a second sensor 41, mounted under the sleeving station 20 is triggered by the pusher means 18 on the second belt means 17. The second sensor 41, deactivates the drive for the second belt means 17. Introduction of a new tray 12 in the transport station resumes the cycle, an opened sleeve 21 being available in the sleeving station 20.

A starting switch 45 to provide power to the sleeving machine 10 is mounted on the frame 11 near the transport station. The starting switch 45 has a time delay to assure the safety of the persons operating the machine. The switch 45 preferably has a button which must be held for approximately 5 seconds to start the machine. An audible sound (such as a buzzer) and a visual signal (a light) are produced when the button is held. Additional safety features of the machine are four emergency stop switches 46 and four associated visual indicators 47 disposed about the sleeving machine 10. Each emergency stop switch 46 completely removes power from the sleeving machine 46 and simultaneously, activates the visual indictor 47 which is located near the respective emergency stop switch 46. In this manner, the emergency stop switch 46 which was used is immediately identified. A series of safety cut-off switches are included in the machine to protect the equipment from accidental damage if non-standard sleeves or trays are introduced. Also, if the sleeving operation is interrupted or the hopper 25 is empty and no longer has sleeves 21, a system malfunction sensor detects the interruption and stops the sleeving machine 10. The entire sleeving machine 10, preferably is semi-enclosed to preclude injuries to persons operating the equipment. If desired a computerized control system and microprocessor may be utilized to control the machine and to coordinate the machine with a conveyor line at the inlet and outlet of the machine.

The method of automatically sleeving the tray 12 using the sleeving machine 10 is as follows:

The starting switch 45 is turned on and the first belt means 16 is activated. Also, sensing means 33 overrides third sensor 42, the hopper belts 27 are activated and a sleeve 21 is pushed into the sleeving station 20, where the sleeve 21 is opened. The third sensor 42 deactivates the hopper belts 27. A tray 12 containing mail is placed on the first end 14 of the transport station 13 and the tray 12 advances to the second end 15 of the transport 13. The second belt means 17 is activated by the first sensor 40 and the pusher means 18 engages the tray 12 and advances the tray 12 against the flaps 35, 36, 38. The flaps 35, 36, 38 are hingedly moved to assist in holding the opened sleeve 12 and to guide the tray 12 into the sleeve 21. The tray 12 is pushed into the sleeve 21 by the pusher means 18 and the sleeve 21 with the tray 12 therein is pushed out of the sleeving station 20. The second sensor 41 is triggered by the pusher means 18 and the second belt means 17 is deactivated. When the opened sleeve 21 is removed from the sensing station 20, the sensing means 33 concurrently overrides the third sensor 42 and activates the hopper belts 27, so that a sleeve is dispensed and opened in the sleeving station 20. Another tray is received in the transport station 13 and the operation is repeated. The hopper 25 is refilled with collapsed sleeves 21 as needed.

The sleeving machine 10 can be automatically operated at a linear rate of 120 to 200 feet per minute. This rate of operation translates to approximately 600 to 1,800 trays 12 being sleeved in one hour. The postal service has established a linear rate of 130 ft./min. for automatic transport of mail. When operating at a conveyor speed of 130 feet per minute, approximately one and six-tenth (1.6) seconds are required from the entry of the tray 12 on the first end 14 of the transport station 13 to the entry of the tray 12 into the sleeving station 20. Approximately four-tenth (0.4) seconds are required to complete the sleeving operation. Thus, a sleeving cycle is completed in approximately 2 seconds with an 1,800 tray/hr. throughput.

The sleeving machine 10 is capable of operating with used trays 12 and used sleeves 21 so long as these units are undamaged. Many of the used trays 12 and sleeves 21 were unusable for manual operation.

Thus, the present invention provides automated equipment which is more efficient and more rapid than previously available equipment or procedures, and which is compatible with postal service operations. The present invention is safe for use.

What is claimed is:

1. A sleeving machine for automatically inserting a tray of postal mail into a sleeve, the sleeve having a top, a bottom, two sides and two open ends, the machine comprising:

a transport station having a first side, a second side, a first end and a second end, the sides being substantially perpendicular to the ends, a first continuous belt means disposed between the sides of the transport station such that when the tray is disposed on the first belt means, the tray may be moved from the first end to the second end of the transport station, a second continuous belt means disposed adjacent to and parallel to the first belt means between the sides of the transport station, at least one pusher means attached to the second belt means such that the at least one pusher means may engage the tray;

a sleeving station adjacent to the second end of the transport station, the sleeving station having a first side and an opposite second side, the second belt means extending through the sleeving station between the sides of the sleeving station wherein the at least one pusher means advances the tray in a direction from the transport station to the sleeving station;

a hopper adjoining the first side of the sleeving station, the hopper containing therein a plurality of collapsed sleeves, means for dispensing the collapsed sleeves one at a time as desired, into the sleeving station, means disposed solely on the second side of the sleeving station distal from the hopper for opening the collapsed sleeve wherein the open ends of the sleeve are oriented in the direction of movement of the tray such that the tray may be advanced by the at least one pusher means and be disposed inside the opened sleeve;

power means to drive the first belt means, the second belt means and the means for dispensing the collapsed sleeve from the hopper;

sensing means to coordinate the movement of the second belt means with the means for dispensing the collapsed sleeve, to assure continuous, uninterrupted advancement of the tray and insertion of the tray into the opened sleeve, to permit the at least one pusher means to advance the sleeve containing the tray out of the sleeving station and to further permit sequential repetition by the machine.

2. The sleeving machine of claim 1, wherein the first belt means comprises two spaced-apart belts, the second belt means being disposed in the space between the belts of the first belt means, the second belt means being on an approximate center line of the transport station.

3. The sleeving machine of claim 2, further comprising the tray having an end, said end having a midpoint, the at least one pusher means attached to the second belt engaging the tray at approximately the midpoint of the end of the tray such that the tray is advanced in an approximately straight line.

4. The sleeving machine of claim 1, wherein the at least one pusher means has a tongue-like shape extending outwardly from the second belt means wherein the tongue-like shape cooperates with the tray to facilitate advancement of the tray.

5. The sleeving machine of claim 1, further comprising a pair of guides, one guide disposed on each respective side of the transport station, said guides directing the tray toward the sleeving station.

6. The sleeving machine of claim 1, further comprising a resilient stop means attached to the sleeving station distal from the transport station, wherein when the tray is advanced from the transport station into the opened sleeve in the sleeving station, the tray is stopped by the resilient stop means and when the at least one pusher means advances the sleeve containing the tray, the resilient stop means is overcome permitting exit of the sleeve containing the tray from the sleeving station.

7. The sleeving machine of claim 1, wherein the means for dispensing the collapsed sleeves one at a time from the hopper comprises the hopper having a bottom, at least one hopper belt disposed on the bottom of the hopper, the at least one hopper belt being oriented at an angle of 90° with respect to the second belt in the sleeving station, the at least one hopper belt engaging the collapsed sleeve disposed against the bottom of the hopper, the at least one hopper belt transporting the collapsed sleeve onto the sleeving station.

8. The sleeving machine of claim 7, further comprising a sleeve pusher bar connected to the hopper belt, wherein the sleeve pusher bar engages the collapsed sleeve on the bottom of the hopper and pushes the collapsed sleeve onto the sleeving station.

9. The sleeving machine of claim 1, further comprising at least one arcuate guide disposed near the second side of the sleeving station distal from the hopper, at least one member connected to the second side of the sleeving station, said member extending toward the hopper and being substantially perpendicular to the hopper, wherein when the collapsed sleeve is dispensed from the hopper, the collapsed sleeve engages the at least one arcuate guide, the collapsed sleeve opens such that the top of the sleeve contacts the at least one member on the distal side of the sleeving station and the opened sleeve is held in position to receive the tray.

10. The sleeving machine of claim 1, wherein flaps are disposed between the second end of the transport station and the sleeving station, a first two flaps being mounted extending upwardly side-by-side in a hinged manner, the flaps straddling the second belt means, a second two flaps being mounted on opposite sides of the transport station extending inwardly toward the second belt means in a hinged manner, and a third flap mounted above the first two flaps and extending downwardly in a hinged manner, wherein when the tray is advanced by the pusher means, the first two flaps are moved into the opened sleeve in the sleeving station contacting the bottom of the opened sleeve, the second two flaps are moved into the opened sleeve in the sleeving station contacting the sides of the opened sleeve, and the third flap is moved into the opened sleeve in the sleeving station contacting the top of the opened sleeve, wherein the sleeve is held in an opened position and entry of the tray into the opened sleeve is facilitated and, when the sleeve containing the tray is advanced out of the sleeving station, the flaps return to the respective upward, inward and downward dispositions.

11. The sleeving machine of claim 1, further comprising two spaced-apart pusher means attached to the second belt means.

12. The sleeving station of claim 1, wherein the sensing means comprises a first sensor which activates the second belt means when a tray is disposed on the first belt means, a second sensor which is activated by the at least one pusher means to deactivate the second belt means when the sleeve containing the tray has been advanced out of the sleeving station, and a third sensor mounted in the sleeving station which senses when an opened sleeve is removed from the sleeving station and thereupon activates the means for dispensing the collapsed sleeve into sleeving station, such that the sleeve may be opened to receive the tray.

13. The sleeving machine of claim 1, further comprising a starting switch to provide power to the sleeving machine, the starting switch having a time delay to assure safety of operation, the starting switch being connected to a warning means before the sleeving machine begins operation.

14. The sleeving machine of claim 1, further comprising four emergency stop switches disposed about the sleeving machine,each emergency stop switch being capable of removing power from the sleeving machine and simultaneously activating a visual means to indicate the respective emergency stop switch.

15. The sleeving machine of claim 1, the sleeving machine being operated at a linear rate of 120 to 200 feet per minute wherein, in one hour, approximately 600 to 1,800 trays are inserted into respective sleeves.

16. A sleeving machine for automatically inserting a tray of postal mail into a sleeve, the sleeve having a top, a bottom, two sides and two open ends, the machine comprising:

a transport station having a first side, a second side, a first end and a second end, the sides being substantially perpendicular to the ends, a first continuous belt means disposed between the sides of the transport station such that when the tray is disposed on the first belt means, the tray may be moved from the first end to the second end of the transport station, a second continuous belt means disposed adjacent to and parallel to the first belt means between the sides of the transport station, at least one pusher means attached to the second belt means such that the at least one pusher means may engage the tray;

a sleeving station adjacent to the second end of the transport station, the sleeving station having a first side and a second opposite side, the second belt means extending through the sleeving station between the sides of the sleeving station wherein the at least one pusher means advances the tray in a direction from the transport station to the sleeving station;

a hopper adjoining the first side of the sleeving station, the hopper containing therein a plurality of collapsed sleeves, means for dispensing the collapsed sleeves, one at a time as desired, into the sleeving station, at least one arcuate guide disposed on the second side of the sleeving station, at least one member being connected to the second side of the sleeving station, the at least one member being substantially parallel to the second belt means wherein when the collapsed sleeve is dispensed from the hopper, the collapsed sleeve engages the at least one arcuate guide and the collapsed sleeve opens such that the top of the sleeve contacts the at least one member and the opened sleeve is held in position to receive the tray;

flaps disposed between the second end of the transport station and the sleeving station, a first two flaps mounted on the sleeving station extending upwardly side by side in a hinged resilient manner, the flaps straddling the second belt means, a second two flaps mounted on opposite sides of the transport station extending inwardly toward the second belt means, a third flap mounted above the first two flaps and extending downwardly in a hinged resilient manner, wherein when the tray is advanced by the pusher means, the first two flaps are moved into the opened sleeve, contacting the bottom of the sleeve, the second two flaps are moved into the opened sleeve, contacting the sides and the third flap is moved into the opened sleeve, contacting the top of the sleeve, wherein the sleeve is held in an opened position and entry of the tray into the opened sleeve is facilitated and when the sleeve containing the tray is advanced out of the sleeving station, the flaps are urged to return to the respective upward, inward and downward dispositions;

power means to drive the first belt means, the second belt means and the means for dispensing the collapsed sleeve from the hopper;

sensing means to coordinate the movement of the second belt means with the means for dispensing the collapsed sleeve, to assure continuous, uninterrupted advancement of the tray, insertion of the tray into the opened sleeve, to permit the at least one pusher means to advance the sleeve containing the tray out of the sleeving station and to further permit sequential repetition by the machine.

17. A sleeving machine for automatically inserting a tray of postal mail into a sleeve, the sleeve having a top, a bottom, two sides and two open ends, the machine comprising:

a transport station having a first side, a second side, a first end and a second end, the sides being substantially perpendicular to the ends, at least one belt disposed between the sides of the transport station such that the tray may be moved from the first end to the second end of the transport station;

the tray having an end, said end having a midpoint;

at least one pusher means attached to the at least one belt, the at least one pusher means having a tongue-like shape extending outwardly from the at least one belt wherein the tongue-like shape engages and cooperates with midpoint on the end of the tray to facilitate advancement of the tray;

a pair of guides, one guide disposed on each respective side of the transport station, said guides directing the tray toward a sleeving station;

the sleeving station adjacent to the second end of the transport station, the sleeving station having a first side and an opposite second side, the at least one belt extending through the sleeving station between the sides of the sleeving station wherein the at least one pusher means advances the tray in a direction from the transport station to the sleeving station;

a hopper adjoining the first side of the sleeving station, the hopper containing therein a plurality of collapsed sleeves, means for dispensing the collapsed sleeves one at a time as desired, into the sleeving station, means disposed solely on the second side of the sleeving station distal from the hopper for opening the collapsed sleeves wherein the open ends of the sleeve are oriented in the direction of movement of the tray such that the tray may be advanced by the at least one pusher means and be disposed inside the opened sleeve;

power means to drive the at least one belt and the means for dispensing the collapsed sleeve from the hopper;

sensing means to coordinate the movement of the at least one belt with the means for dispensing the collapsed sleeve, to assure continuous, uninterrupted advancement of the tray and insertion of the tray into the opened sleeve, to permit the at least one pusher means to advance the sleeve containing the tray out of the sleeving station and to further permit sequential repetition by the machine.

18. A method for automatically inserting a tray of postal mail into a sleeve, the sleeve having a top, a bottom, two sides and two open ends, the method comprising the steps of:

providing a transport station having a first side, a second side, a first end and a second end, the sides being substantially perpendicular to the ends;

providing a first continuous belt means disposed between the sides of the transport station, providing a second continuous belt means disposed adjacent to and parallel to the first belt means between the sides of the transport station, providing at least one pusher means attached to the second belt means such that the at least one pusher means may engage the tray;

placing the tray on the first belt means at the first end of the transport station and moving said tray to the second end of the transport station;

providing a sleeving station adjacent to the second end of the transport station, said sleeving station having a first side an opposite second side, the second belt means extending through the sleeving station between the sides of the sleeving station wherein the at least one pusher means advances the tray in a direction from the transport station to the sleeving station;

providing a hopper adjoining the first side of the the sleeving station, the hopper containing therein a plurality of collapsed sleeves, providing means for dispensing the collapsed sleeves one at a time as desired, into the sleeving station, providing means within the sleeving station and on said opposite second side for opening the collapsed sleeves wherein the open ends of the sleeve are oriented in the direction of movement of the tray such that the tray may be advanced by the at least one pusher means and be disposed inside the opened sleeve;

dispensing the sleeve into the sleeving station;

moving the collapsed sleeve laterally from the hopper across the sleeving station to the sleeve opening means and opening the collapsed sleeve while maintaining said sleeve opening means on said opposite second side;

providing sensing means, wherein the sensing means comprises a first sensor which activates the second belt means when a tray is disposed on the first belt means, a second sensor which is activated by the at least one pusher means to deactivate the second belt means when the sleeve containing the tray has been advanced out of the sleeving station, and a third sensor mounted in the sleeving station which senses when an opened sleeve is removed from the sleeving station and thereupon activates the means for dispensing the collapsed sleeve into the sleeving station, such that the sleeve may be opened to receive the tray;

advancing the tray into the opened sleeve in the sleeving station and pushing the sleeve containing the tray out of the sleeving station and sequentially repeating of the steps and operating the sleeving machine at a linear rate of 120 to 200 feet per minute so that, in one hour, approximately 600 to 1,800 trays are inserted into respective sleeves.

* * * * *